United States Patent [19]

Bloching et al.

[11] 4,142,999

[45] Mar. 6, 1979

[54] STABILIZED LIQUID ENZYME CONTAINING COMPOSITIONS

[75] Inventors: Helmut Bloching, Hilden; Peter Krings, Krefeld; Hans Pfeiffer, Haan, all of Fed. Rep. of Germany

[73] Assignee: Henkel Kommanditgesellschaft auf Aktien, Düsseldorf-Holthausen, Fed. Rep. of Germany

[21] Appl. No.: 817,140

[22] Filed: Jul. 20, 1977

[30] Foreign Application Priority Data

Jul. 27, 1976 [DE] Fed. Rep. of Germany ..... 2633601

[51] Int. Cl.[2] ..... C11D 3/26; C11D 7/32

[52] U.S. Cl. ..... 252/544; 252/89 R; 252/DIG. 12; 252/117; 252/132; 252/156; 252/541; 195/63

[58] Field of Search ..... 252/89, DIG. 12, 541, 252/106, 117, 132, 544; 195/63, 68

[56] References Cited

U.S. PATENT DOCUMENTS

| | | | |
|---|---|---|---|
| 3,627,688 | 12/1971 | McCarty et al. | 252/89 X |
| 4,021,377 | 5/1977 | Borchert et al. | 252/DIG. 12 |

*Primary Examiner*—Mayer Weinblatt
*Attorney, Agent, or Firm*—Hammond & Littel

[57] ABSTRACT

A liquid concentrate which has a content of proteases and/or amylases, non-ionic and optionally anionic surfactants, water and optionally solvents selected from mono- and poly-valent alcohols and ethers thereof, which concentrate contains an alkoxylated alkylamine of the formula

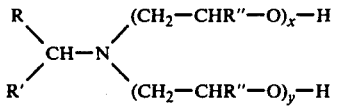

wherein R is alkyl of 4 to 20 carbon atoms, R′ is hydrogen or alkyl of 1 to 10 carbon atoms, provided that the sum of the carbon atoms in R and R′ is from 9 to 19, R″ is hydrogen, methyl or hydroxymethyl, x is an integer from 1 to 5, and y is 0 or an integer from 1 to 5, provided that the sum of x and y is from 1 to 10; as well as its use as a washing and cleaning agent and washing and cleaning formulations containing the same.

14 Claims, No Drawings

STABILIZED LIQUID ENZYME CONTAINING COMPOSITIONS

RELATED ART

Liquid, enzyme-containing washing agent concentrates have a number of advantages as compared with pulverulent products. Substantial simplifications ensue particularly during manufacture, since the preparations, which are obtained during the production of the enzymes, and which are separated from the nutrient solutions by filtration or centrifuging, do not have to be subjected to a drying process and may be further processed in a moist state, thus avoiding any possible trouble caused by enzyme dust. Furthermore, liquid preparations can be metered in a particularly satisfactory manner during use and make it possible to use automatic metering devices. However, problems can arise owing to the fact that enzymes decompose substantially more rapidly in solution, particularly in the presence of water, than in a dried state.

U.S. Pat. No. 3,627,688 describes aqueous enzyme preparations which contain dialkyl polyglycol ether in addition to non-ionic or zwitterionic surfactants. However, the stabilizing action of these compounds is inadequate, particularly when anionic surfactants are additionally added.

Liquid, enzyme-containing concentrates having substantially improved stability are described in German Offenlegungsschrift No. 2,038,107. The concentrates contain, as stabilizers, a first component comprising polyvalent aliphatic alcohols, and alkyl- or hydroxyalkylamides or dialkylsulfoxides derived from carboxylic acids of phosphoric acid, and a second component in the form of hydroxyalkylamines which are derived from aliphatic or heterocyclic amines which optionally contain hydroxyl groups and which have a maximum of 8 carbon atoms. Low molecular weight carboxylic acids can also be present as a further stabilizing agent. German Offenlegungsschrift No. 2,058,826 describes agents of similar composition in which the aliphatic or heterocyclic amines are entirely or partially replaced by diamines or polyamines which contain aliphatic or alicyclic hydroxyalkyl groups and which have a maximum of 8 carbon atoms in the molecule. These stabilizers develop their optimum effect in a slightly acid to neutral environment or in the absence of anionic surfactants. However, since there is a special interest in concentrates for use in an alkaline environment, which also optionally contain anionic surfactants, the problem arose of further improving the stability of agents of this type.

OBJECTS OF THE INVENTION

An object of the invention is, therefore, to provide a stabilized liquid enzyme preparation which substantially retains its enzyme activity upon storage.

Another object of the invention is to provide a liquid proteolytic and/or amylolytic enzyme-containing composition stabilized against loss of activity by the presence of an enzyme-stabilizing compound.

A further object of the invention is to provide a stabilized liquid enzyme-containing concentrate which is usable as a washing and cleaning agent.

These and other objects of the present invention will become more apparent as the description thereof proceeds.

DESCRIPTION OF THE INVENTION

These and other objects of the present invention have been achieved by the discovery of a stabilized liquid enzyme-containing concentrate which can be used as a washing and cleaning agent and which comprises a content of proteases and/or amylases, non-ionic and, optionally, anionic surfactants, water and, optionally, solvents or additional substances promoting the stability of the enzymes selected from the class of mono- and polyvalent alcohols and ethers thereof, and an effective amount of an alkoxylated alkylamine of the formula

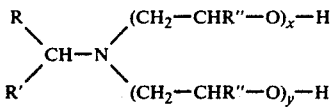

wherein R is an alkyl group having 4 to 20 carbon atoms, R′ is hydrogen or an alkyl group having 1 to 10 carbon atoms, provided that the total carbon atoms of R and R′ is from 9 to 19 inclusive, R″ is hydrogen, methyl or hydroxymethyl, x is an integer of from 1 to 5 inclusive, and y is 0 or an integer from 1 to 5 inclusive, provided that the sum of x and y is from 1 to 10 inclusive.

More particularly, the invention provides liquid concentrates, usable as washing and cleaning agents, comprising an enzyme preparation containing an enzyme selected from the group consisting of proteases, amylases, and mixtures thereof, non-ionic and, optionally anionic, surfactants, water and, optionally solvents or additional substances promoting the stability of the enzymes selected from the group consisting of mono- or polyvalent alcohols and ethers thereof, and, relative to 1 part by weight of said enzyme preparation having an activity of 10 to 10,000 SKBE/gm amylase or of 1,000 to 1,500,000, perferably 10,000 to 800,000, PE/gm protease, 2 to 500 parts by weight of an alkoxylated alkylamine of the formula

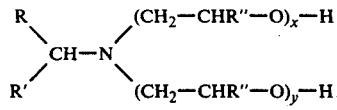

wherein R is an alkyl group having 4 to 20 carbon atoms, R′ is a member selected from the group consisting of hydrogen and an alkyl group having 1 to 10 carbon atoms, provided that the total of the carbon atoms of R and R′ is from 9 to 19 inclusive, R″ is a member selected from the group consisting of hydrogen, a methyl group, and a hydroxymethyl group, x is an integer from 1 to 5 inclusive, and y is 0 or an integer from 1 to 5 inclusive, provided that the sum of x and y is from 1 to 10 inclusive.

Preferably, the quantity of alkoxylated N-alkylamines, relative to 1 part by weight of the above enzyme preparation of the invention, is 5 to 200 parts by weight.

Especially suitable alkoxylated N-alkylamines of the invention contain straight-chain or branched alkyl groups having a total of 10 to 20 carbon atoms as their

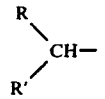

residues. The alkylamines containing straight-chain alkyl groups having a total of 12 to 18 carbon atoms are preferred. In the last-mentioned preferred alkoxylated alkylamines, the group

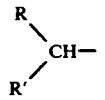

is thus a straight-chain alkyl group. The amino group can be located at the terminal position as well as at an inner position. Suitable starting materials are, for example, the primary $C_{10}$-$C_{20}$ amines produced from fatty acid nitriles of natural origin by hydrogenation, such as decylamine, dodecylamine, tetradecylamine, hexadecylamine, octadecylamine, eicosylamine and mixtures thereof, such as coconut alkyl amine and tallow alkyl amine. The amines can also be of synthetic origin, as for example, derived from oxo compounds or obtained from mineral oil hydrocarbons. This group includes, in addition to the above-mentioned amines, undecylamine, tridecylamine, pentadecylamine and heptadecylamine, wherein the amino group may be optionally located on any carbon atom of the alkyl chain.

The alkylene oxide groups, on which the polyether radicals of the alkoxylated alkylamines of the invention are based, can be derived from ethylene oxide (R'' = H), propylene oxide (R'' = $CH_3$) or glycidol (R'' = —$CH_2OH$) or mixtures thereof. Preferably, the derivatives of ethylene oxide are used in the invention. The alkoxylated alkylamines having a total of 1 to 6 ethylene glycol ether groups have proved to be particularly successful.

Examples of suitable alkoxylated alkylamines (the abbreviation EO representing added ethylene oxide groups) are dodecylamine-1 EO, dodecylamine-2 EO, dodecylamine-3 EO, dodecylamine-4 EO, dodecylamine-5 EO, tetradecylamine-1 EO, tetradecylamine-2 EO, tetradecylamine-3 EO, tetradecylamine-4 EO, tetradecylamine-5 EO, hexadecylamine-2 EO, hexadecylamine-3 EO, hexadecylamine-4 EO, hexadecylamine-5 EO, hexadecylamine-6 EO, octadecylamine-2 EO, octadecylamine-3 EO, octadecylamine-4 EO, octadecylamine-5 EO, octadecylamine-6 EO, coconut alkylamine-1 EO, coconut alkylamine-2 EO, coconut alkylamine-3 EO, coconut alkylamine-4 EO, coconut alkylamine-5 EO, tallow alkylamine-2 EO, tallow alkylamine-3 EO, tallow alkylamine-4 EO, tallow alkylamine-5 EO, tallow alkylamine-6 EO.

The enzymes contained in the agents in accordance with the invention can be of vegetable, animal or bacterial origin. The activity of the proteases involved in the present invention is given in "PE" (Protease units) which can be determined by the method given by H. B. van Raay, H. Saran and H. Verbeek in the Journal "Surfactants", 7 (1970), pages 125–132.

The following species of bacteria may act as the source of bacterial amylases and proteases: bacillus types such as *B. subtilis, B. cereus, B. licheniformus, B. mesentericus, B. brevis,* lactic acid bacteria, micrococci, Pseudomonas, Arthrobacter, Klebsiella, coli-, proteus- and serratia types. The following may act as the source of fungus amylases and proteases: actinomycetes streptomycetes, alternaries, sporangies, microspora-, pencillium-, cephalosporium, rhizopus-, keratinomyces, aspergillus-, mucro-, gliocladeum-, mortierella types, as well as yeasts (Candida, Saccharomyces).

The amylases are preferably amylases which liquify starch and/or saccharogenic amylases, both of which can be produced from cereal grain. Commercially available amylases which are usable in accordance with the invention are, for example, the following commercial products (the names of suppliers are also included):

| | |
|---|---|
| α-amylase | Midwest Biochemical Company, Milwaukee, Wisconsin/USA |
| α-amylase | Nagase & Co., Osaka/Japan |
| α-amylase | Wallerstein Company, Staten Island, New York/USA |
| Amylase 1000 | Societe Rapidase, France |
| Amylase preparation 2205/2209 | Rohm & Haas GmbH., Darmstadt |
| Anamyl | Organon |
| Bacterial α-amylase, BAN | Novo Industri A/S, Bagsvaerd, Denmark |
| Bacteria amylase A | Rohm & Haas GmbH., Darmstadt |
| Biokleistase M16 | Daiwa Kasei KK, Osaka |
| Clarase | Miles Laboratories, Inc, Elkhart, Indiana/USA |
| Fungamyl | Novo Industri A/S, Bagsvaerd. Denmark |
| Maxazyme FA | Gist Brocades NV., Delft, Holland |
| Maxamyl | Gist Brocades NV., Delft, Holland |
| Fungus amylase | Schweizerische Ferment AG., Basel |
| Rapidase 75 | Societe Rapidase, France |
| Rhozyme H 39 | Rohm & Haas, Philadelphia |
| Speedase K & G | Nagase & Co., Osaka/Japan |
| Termamyl | Nova Industri A/S, Bagsvaerd, Denmark |

Usable as proteases are peptidylpeptidhydrolases such as leucineaminopeptidase, aminopeptidases, carboxypeptidases, di- and tripeptidases, pepsin, rennin, trypsin, chymotrypsin, pancreaspeptidase, enteropeptidase, cathepsins, collagenase, elastase, papain, chymopapain, ficin, subtilopeptidases, aspergillopeptidases, streptococcuspeptidases chlostridiopeptidases, thermolysin, streptomycespeptidases, bromelain and keratinase. Other examples of proteases which are usable for the purposes of the invention are aspergillopeptidase A and aspergillopeptidase B, as well as those proteolytic enzymes which are isolated from streptomycose types. Subtilisin, BPN' and the proteases isolated from streptomyces types are preferably used as proteases.

Commercially available protease products can also be used for the purposes of the invention. The commercially available enzyme products which contain proteases and frequently certain quantities of amylases, are generally marketed in a pulverulent form. They are composed of active enzymes combined with relatively inert constituents such as sodium-or calcium sulfate or sodium chloride. By way of example, the following proteases are commercially available (the names of suppliers are also included):

| | |
|---|---|
| Alcalase | Novo Industri A/S, Bagsvaerd, Denmark |
| Alkaline protease | N.V. Organon-Oss-Niederlande |
| Alkaline protease 200+/290 | Takeda Chemical Industries, Japan |
| Bioprase | Nagase & Co. Ltd., Osaka/Japan |
| Bromelain | Takamine, Clifton, New Jersey (Miles) |
| CRD protease (contains some α-amylase) | Monsanto Company, St. Louis, Missouri/USA |
| Enzyme AG-22 | Monsanto Company, Missour/USA |

-continued

| | |
|---|---|
| Enzyme AP densified | Monsanto Company, Missouri/USA |
| Esperase | Novo Industri A/S, Bagsvaerd, Denmark |
| Ficin | Takamine, Clifton, New Jersey (Miles) |
| HT proteolytic enzyme 200 | Miles Laboratories, Inc. Elkhart, Indiana/USA |
| HAT proteolytic enzyme 7XB | Miles Laboratories, Inc. Elkhart, Indiana/USA |
| Matsulase MGI-10+/20 | Matsutanie Chemical & Co. Ltd., Japan (Mitsubishi) |
| Maxatase | Gist Brocades NV., Delft |
| Optimase | Miles Kali-Chemie GmbH, Nienburg |
| P-11 concentrate | Rohn & Haas, Philadelphia, Pennsylvania/USA |
| Pronase | Kaken Chemical Company, Japan |
| Protease 2200 A | Rohm & Haas, GmbH, Darmstadt |
| Protease AP 10 × | Schweizerische Ferment AG, Basel |
| Protease B-4000 | Sandoz, Basel/Switzerland |
| Protease Hoechst 1549-1 | Farbwerke Hoechst, Frankfurt |
| Protin AS | Daiwa Kasei KK, Osaka/Japan |
| Rapidase 75 | Societe Rapidase, France |
| Rapidase 400 | Rapidase, Seclin, France |
| Rhozym J-25, PF | Rohm & Haas, Philadelphia, Pennsylvania/USA |
| Sandoz AP | Sandoz, Basel/Switzerland |
| SP 88 | Novo Industri A/S, Bagsvaerd, Denmark |
| Tasinase B-11-100 | Kyowa Hakko Co., Japan |
| Thermoase | Daiwa Kasei KK, Osaka/Japan |
| Wallerstein 627-P | Wallerstein Company, Staten Island, New York/USA |

All the above enzymes can be used as technically produced, raw aqueous solutions, or in a further processed form, to produce the liquid, stabilized enzyme preparations in accordance with the invention. Thus, for example, it is possible to directly use the aqueous solutions which are produced as secretions of organs or as obtained after separation of the enzyme producing microorganisms.

Preferably, however, the enzymes will be purified and concentrated by, for example, ultrafiltration methods or ion exchange methods. However, it is also possible to directly process the still wet filter cakes, resulting during the filtering of precipitated enzymes, to form the solutions in accordance with the invention. If the processing method is based on solid enzyme preparations, they are dissolved in water or aqueous buffer solutions.

Alternatively, however, the enzymatically ineffective accompanying substances, which are usually present in the commercially available enzyme preparations in addition to the actual enzymatically effective substance, and which may be albumen substances or other substances originating from production or preparation, as well as, for example, inorganic salts, can remain in the solution, since they are not detrimental to most of the purposes for which the enzymes are used.

The above-mentioned amylase activities of 10–10,000 SKBE/gm or protease activities of 1,000–1,500,000 PE/gm represent the activities of those enzyme preparations which, at the filing date of this application, appear to be economical for use in washing and cleaning agents and in the cosmetic field. The liquid compositions of the invention containing these enzymes of high activity represent a preferred embodiment of the invention. From the chemical-technical standpoint, the enzyme activities of the preparations can be increased as required, so that the activities of proteases and amylases can be increased to, for example, fivefold the maximum values given above. Thus, if preparations having such high activities should become readily obtainable in future and appear to be suitable, from an economic point of view, for use in the above-mentioned fields of application, liquid enzyme-containing compositions having correspondingly higher enzyme activities will be similarly readily obtainable.

Suitable solvents or additional substances promoting the stability of the enzymes are water-miscible mono- and polyvalent alcohols, water-miscible polyethers of polyvalent alcohols and those water-miscible partial ethers of polyvalent alcohols which contain at least one hydroxyl group.

Suitable monovalent alcohols are water-soluble alkanols such as methanol, ethanol, propanol and isopropanol. Suitable as the polyvalent alcohol additives are the bi- to hexavalent aliphatic alcohols (especially alkane polyols containing 2 to 6 carbon atoms), which include, for example, alkane diols such as ethylene glycol, 1,2-propylene glycol, 1,3-propylene glycol, 1,2-butylene glycol, 1,3-butylene glycol and 1,4-butylene glycol, dihydroxypentanes such as neopentyl glycol; glycerin; sugar alcohols such as dulcitol, mannitol, xylitol, and sorbitol, etc. Ethers or polyethers of these polyvalent alcohols useful in the invention are, for example, ethers of ethylene glycol, diethylene glycol, triethylene glycol, or polyethylene glycols and the polyethers of glycerin. Those polyethers are especially useful which are still liquid at room temperature. The alkyl ethers of alkyl alcohols are particularly suitable. The partial ethers of the polyvalent alcohols containing at least one hydroxyl group in the molecule, or the ethers or polyethers thereof with monovalent alcohols containing 1 to 4 carbon atoms, include, for example, the methyl-, ethyl-, propyl-, or butylethers of ethyleneglycol, di- or triethyleneglycol, or glycerin; the corresponding ethers of glycerin, particularly glycerin-α-monomethylether or glycerin isopropylidene ether, have proved to be particularly effective.

Additives which are also usable in the compositions of the invention are, for example, hydroxyalkylamines having 2 to 8, preferably 2 to 6, carbon atoms per hydrocarbon radical, such as mono-, di- and triethanolamine, mono-, di-, or triisopropanolamine, as well as derivatives of these hydroxyalkylamine compounds which have at least one hydroxyl group in the molecule and which have structures wherein the said alkylol radicals are replaced by $C_{1-4}$-alkyl radicals or by cyclohexyl or cyclopentyl groups, such as N-methyldiethanolamine, N,N-dibutyl-ethanolamine, N-2-hydroxypropylbutylamine-1, N,N-di-(2-hydroxypropyl)-butylamine, N,N-di-(2-hydroxyethyl)-cyclohexylamine, N-2-hydroxypropyl-butylamine, N-1-hydroxypropyl-dimethylamine, and N-2-hydroxyethylcyclohexylamine.

Other suitable amine additives usable in the compositions of the invention are those substituted on nitrogen by groups of the formula $$-R_1\,OR_2 \text{ or } -R_1\,\overset{\overset{\displaystyle O}{\|}}{C}R_2$$

wherein $R_1$ is alkylene, preferably alkylene of 2 or 3 carbon atoms, and $R_2$ is alkyl, preferably alkyl of 1 or 2 carbon atoms, the remaining 2 substituents on nitrogen being selected from the group consisting of hydrogen and alkyl groups, preferably alkyl groups of 1 to 3 carbon atoms. Examples of such suitable amines are methoxyethylamine, 3-methoxy- or 3-ethoxy-propylamine, ethoxyethylamine, methoxyethyl- or ethoxyethylpropylamine and 1-diethylaminopentanone-4.

The amount of the above-mentioned amines in the compositions of the invention can be chosen so that the pH value of the concentrates, including other optional acid or alkaline components contained therein, is 7 to 11, preferably 8 to 10.

Further suitable mixture components of the compositions of the invention are preferably non-ionic and, if required, anionic surfactants.

Suitable non-ionic surfactants are the polyglycol ether derivatives of alcohols, diols, fatty acids, fatty acid amides and alkyl phenols which contain 3 to 30 glycol ether groups and 8 to 20 carbon atoms in the hydrocarbon radical. Those non-ionic surfactants containing ethylene glycol ether groups are particularly useful. Among the latter polyglycol ether derivatives, those are particularly suitable in which the number of ethylene glycol ether groups is 5 to 15 and in which the hydrocarbon radicals are derived from straight-chain, primary alcohols having 12 to 18 carbon atoms or from alkyl phenols having a straight-chain alkyl chain having 6 to 14 carbon atoms. Included among the straight-chain primary alcohols are alkanols and alkenols of both synthetic and natural origin. Advantageously, mixtures of lower and higher ethoxylated compounds can also be added to the compositions of the invention in their use as washing agents. Furthermore, non-ionic compounds of the amine oxide and sulfoxide type, which may optionally be ethoxylated, are also usable in the compositions of the invention.

Further non-ionic surfactants, particularly suitable for dish-washing agents for use in machines, are the water-soluble addition products of ethylene oxide onto polyoxypropylene glycol and alkylene diamine polyoxypropylene glycol. Particularly suitable are the water-soluble polyethylene oxide adducts to polypropylene glycol and ethylene diamine polypropylene glycol, which contain 20 to 250 ethylene glycol ether groups and 10 to 100 propylene glycol ether groups. Said compounds normally contain 1 to 5 ethylene glycol units per propylene glycol unit. Ethoxylated and subsequently propoxylated fatty alcohols, secondary alcohols and alkyl phenols having 5 to 35 ethylene glycol or propylene glycol ether groups in each case, are also suitable for the same purpose. Also suitable are ethoxylated primary and secondary alcohols and alkyl phenols having a terminal hydroxyl group which is alkylated, acylated or acetalized. Agents of the invention having an increased foaming action can contain, instead of the aforesaid substances, fatty acid monoalkanolamides and dialkanolamides, such as the mono- or diethanolamide or mono- or diisopropanolamide of lauric-, myristic-, palmitic- and oleic acid or of coconut fatty acids.

Suitable anionic surfactants for use in the compositions of the invention are those of the sulfonate or sulfate type, such as alkylbenzene sulfonates, particularly n-dodecylbenzene sulfonate, as well as olefin sulfonates, alkyl sulfonates, $\alpha$-sulfo fatty acid esters, primary and secondary alkyl sulfates, and the sulfates of ethoxylated or propoxylated higher molecular weight alcohols.

Further compounds of this class, which may be optionally present in the agents of the invention, are the higher molecular weight sulfated partial ethers and partial esters of polyvalent alcohols, such as the alkali metal salts of monoalkylethers or the mono- fatty acid esters of glycerin monosulfuric acid ester or of 1,2-dihydroxypropane sulfonic acid. Also suitable are sulfates of ethoxylated or propoxylated fatty acid amides and alkyl phenols, as well as fatty acid taurides and fatty acid isethionates. Eminently suitable anionic surfactants have proved to be the alkali metal (e.g. sodium or potassium) or triethanolamine soaps of fatty acids of natural or synthetic origin, such as the soaps of coconut, palm kernel or tallow fatty acids.

In the same way as the soaps, the other anionic surfactants can also be present in the form of sodium, potassium and ammonium salts as well as salts of organic bases such as mono-, di- or triethanolamine. When the above anionic compounds have an aliphatic hydrocarbon radical, the latter is preferably straight-chain and has 8 to 22, particularly 12 to 18, carbon atoms. When the above anionic compounds have an araliphatic hydrocarbon radical, the hydrocarbon chains in said compounds are preferably unbranched alkyl chains and have 6 to 16, preferably 9 to 14, carbon atoms.

Zwitterionic washing substances which are also usable in the compositions of the invention are alkyl betaines and particularly alkyl sulfobetaines, such as 3-(N,N-dimethyl-N-alkylammonium)-propane-1-sulfonate and 3-(N,N-dimethyl-N-alkylammonium)-2-hydroxypropane-1-sulfonate, having 8 to 22, preferably 12 to 18, carbon atoms in the alkyl group.

In order to protect the enzymes present in the products in accordance with the invention from the detrimental influence of microorganisms, it is advantageous to add anti-microbial substances to the liquid enzyme concentrates. By way of example, the following substances may be mentioned from among the large number of antimicrobial substances which may be used: 2,4,6- or 2,4,5-trichlorophenol, 2-hydroxydiphenyl, p-benzylphenol, p-phenylphenol, p-chloro-m-cresol, 1-hydroxypyridinethion-2 (Zn- or Na-salt), 2,2'-dihydroxydichlorodiphenylmethane, 4-hydroxybenzoic acid, bis-(2-hydroxy-3,5,6-trichloro-phenyl)-methane, tribromosalicylanilide, sodium azide, S-ethylmercuric-4-carboxythiophenol, and 1,6-bis-(4-chlorophenylbiguanido)-hexane.

As one skilled in the art will see from the above enumeration, the efficacies of the antimicrobial substances usable for this purpose vary to a considerable extent. Therefore, the quantities used can vary within wide limits of, for example, 0.0005 to 1 percent by weight, preferably from 0.05 to 0.5 percent by weight of the agent of the invention.

Furthermore, solubilizing intermediaries (hydrotropic substances) can be present in the compositions of the invention, such as toluene- xylene- or cumene sulfonate or alkyl sulfates or alkane sulfonates having 6 to 8 carbon atoms in the hydrocarbon radical, or urea. Said sulfonates and sulfates can be present in the form of their sodium-, potassium- or ammonium salts or as salts of organic ammonium bases.

The concentrates of the invention can also contain complex-forming builder substances. Suitable inorganic builder substances are acid or neutral pyrophosphates, polyphosphates, particularly pentasodium-tripolyphosphate and metaphosphates. Usable organic builder substances are the alkali metal salts of nitrilotriacetic acid and ethylenediamine-tetraacetic acid. Also suitable are the salts of diethylenetriamine pentaacetic acid and the higher homologs of the above-mentioned aminopolycarboxylic acids, the alkali metal salts of aminopolyphosphonic acids, particularly aminotri-(methylenephosphonic acid), 1-hydroxyethane-1,1-diphosphonic acid, methylenediphosphonic acid, ethylenediphosphonic acid and salts of the higher homologs of the above-mentioned polyphosphonic acids. Mixtures of the aforesaid complexing agents are likewise suitable.

The above-mentioned builder substances may be entirely or partially replaced by nitrogen- and phosphorus-free polycarboxylic acids which form complex salts with calcium ions, as well as by polymers containing carboxyl groups. Citric acid, tartaric acid, benzene hexacarboxylic acid and tetrahydrofurantetracarboxylic acid are suitable. Polycarboxylic acids containing carboxymethylether groups are also usable, such as 2,2'-oxydisuccinic acid as well as polyvalent alcohols, partially or fully etherified with glycolic acid, or hydroxycarboxylic acids such as triscarboxymethyl glycerin, biscarboxymethyl glycerin acid and carboxymethylated or oxygenated polysaccharides. Also suitable are polymeric carboxylic acids having a molecular weight of at least 350 in the form of water-soluble sodium- or potassium salts, such as polyacrylic acid, polymethacrylic acid, poly-α-hydroxyacrylic acid, polymaleic acid, polyitaconic acid, polymesaconic acid, polybutenetricarboxylic acid, and the copolymers of such monomeric carboxylic acids with one another or with ethylenically unsaturated compounds such as ethylene, propylene, isobutylene, vinylmethylether or furan.

Also, so-called wash alkalis are suitable as constituents of the mixture, such as bicarbonates, carbonates, borates and silicates of sodium and potassium, wherein the silicates can have a ratio of $Na_2O:SiO_2$ of 1:2 to 1:3.5. Neutral salts, such as sodium sulfate, sodium chloride, and sodium acetate can also be present as well as optical brighteners of conventional constitution, and dyes, opacifiers and perfumes.

The quantitative composition of the agents of the invention can fluctuate within wide limits, preferably within the following limits (in percent by weight):

0.01 to 5% of enzyme preparation, the total quantity of said enzyme preparation being dimensioned so that the activity is preferably 100 to 10,000 PE/gm, relative to the agent of the invention,
0.05 to 20% alkoxylated alkylamine, which corresponds in the ratios indicated above to the quantity of the enzyme preparation,
0 to 50%, preferably 0.5 to 30%, of mono- or polyvalent alcohols and/or partial ethers thereof,
0.5 to 40%, preferably 5 to 30%, of nonionic surfactant,
0 to 30%, preferably 1 to 20%, of soap and/or sulfate or sulfonate surfactant,
0 to 25%, preferably 0.5 to 10%, of hydroxyalkylamine, particularly triethanolamine,
0 to 1%, preferably 0.05 to 0.5%, of antimicrobial substances,
0 to 20% of complex-forming builder substances,
0 to 10% of solubilizing intermediary,
0 to 1% of optical brighteners, dyes, perfumes and opacifiers
20 to 50%, preferably 25 to 40%, of water.

EXAMPLES

Typical formulations of washing agent concentrates containing enzymes and of their enzyme activity determined after 12 and 16 weeks are listed in the following Tables.

In the following TABLE I are listed the enzymes and ethoxylated alkylamines used in ten typical liquid concentrates of the invention. In this TABLE I coconut alkylamine is an amine produced by hydrogenation of coconut fatty acid nitriles having chain lengths of $C_{12}$-$C_{18}$ with an average chain length of 13.6. The tallow alkylamine, produced in a corresponding manner, had chain lengths of $C_{16}$-$C_{18}$ with an average chain length of 17.2. The $C_{11-14}$-alkylamine, produced from olefins having an average chain length of $C_{12.5}$, had amino groups statistically distributed over the hydrocarbon chain. The general formula of the $C_{11-14}$-alkylamine-2EO is as follows:

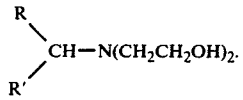

The alkylamine of TABLE I were ethoxylated, the abbreviation in the table consisting of a number followed by EO indicating the number of ethylene oxide groups added.

In the ten comparison liquid concentrates of TABLE I, designated in each case by the letter "a", the ethoxylated amines of the invention are replaced by ethoxylated alcohols (non-ionic surfactants).

Enzyme I in the following tables is the product "Maxatase" of the firm Gist Brocades, Delft, Holland. Enzyme II is the preparation "Esperase" of the firm Novo Industri, Bagsvaerd, Denmark. Enzyme I has an activity of 440,000 PE/gm and Enzyme II has an activity of 35,000 PE/gm, which results in an activity of the liquid concentrate of 440 PE/gm (when using Enzyme I) and 350 PE/gm (when using Enzyme II).

The other components of the liquid concentrates (used in both the liquid concentrates of the invention and the comparison liquid concentrates) are listed in Table II. The $C_{16-18}$ fatty alcohol is derived from tallow fatty alcohols. The quantity of triethanolamine is chosen so that, after neutralization of the fatty acid or of the toluenesulfonic acid, there is still an adequate excess to ensure an alkaline pH value (pH 9.5 to 10).

The concentrates were stored in sealed bottles at a temperature of 23° C. The enzyme activity was determined after 12 and 16 weeks, by the method given by H. B. van Raay, H. Saran and H. Verbeek in the Journal "Surfactants", 7 (1970) pages 125–132. The enzyme activity is given in % of the initial activity of Table III.

TABLE I

| | Example | | | | | | | | | |
|---|---|---|---|---|---|---|---|---|---|---|
| | 1 | 2 | 3 | 4 | 5 | 6 | 7 | 8 | 9 | 10 |
| Enzyme I | 0.1 | — | 0.1 | 0.1 | 0.1 | — | — | — | — | 0.1 |
| Enzyme II | — | 1.0 | — | — | — | 1.0 | 1.0 | 1.0 | 1.0 | — |
| Coconut alkylamine-2 EO | 20 | 10 | — | — | — | — | 10 | — | — | — |
| Tallow alkylamine-5 EO | — | — | 10 | 10 | — | — | — | 10 | — | 10 |
| $C_{11-14}$-alkylamine 2 EO | — | — | — | — | 10 | 10 | — | — | 10 | — |
| | Comparison | | | | | | | | | |
| | 1a | 2a | 3a | 4a | 5a | 6a | 7a | 8a | 9a | 10a |
| Enzyme I | 0.1 | — | 0.1 | 0.1 | 0.1 | — | — | — | 1 | 0.1 |
| Enzyme II | — | 1.0 | — | — | — | 1.0 | 1.0 | 1.0 | — | 5.0 |
| $C_{16-18}$-fatty alcohol-5 EO | — | — | — | 10 | — | 10 | 5.0 | 10 | 10 | 5.0 |
| $C_{16-18}$-fatty alcohol-10 EO | 20 | 10 | 10 | — | 10 | — | 5.0 | — | — | — |

TABLE II

| Other Components of Concentrates | Example 1 | 2 | 3 | 4 | 5 | 6 | 7 | 8 | 9 | 10 |
|---|---|---|---|---|---|---|---|---|---|---|
| $C_{16-18}$-fatty alcohol-5 EO | 20 | 20 | 20 | 10 | 20 | 10 | 5.0 | — | — | 5 |
| $C_{16-18}$-fatty alcohol-10 EO | — | 10 | 10 | 20 | 10 | 20 | 5.0 | 10 | 10 | 5 |
| Coconut fatty acid diethanolamide | — | — | — | — | — | — | 5.0 | 5.0 | 5.0 | 5.0 |
| Na-n-dodecylbenzenesulfonate | — | — | — | — | — | — | 10 | 10 | 10 | 10 |
| Fatty acid (10% coconut, 90% tallow fatty acid) | 5.5 | 5.5 | 5.5 | 5.5 | 5.5 | 5.5 | 3.5 | 3.5 | 3.5 | 3.5 |
| Triethanolamine | 5.0 | 5.0 | 5.0 | 5.0 | 5.0 | 5.0 | 18 | 18 | 18 | 18 |
| Ethanol | 3.0 | 3.0 | 3.0 | 3.0 | 3.0 | 3.0 | 5.0 | 5.0 | 5.0 | 5.0 |
| 1,2-propyleneglycol | 10 | 10 | 10 | 10 | 10 | 10 | — | — | — | — |
| Diethyleneglycolmonobutyl ether | 12 | 12 | 12 | 12 | 12 | 12 | — | — | — | — |
| Toluene sulfonic acid | — | — | — | — | — | — | 7.0 | 7.0 | 7.0 | 7.0 |
| Water | 24.4 | 23.5 | 24.4 | 24.4 | 24.4 | 24.4 | 30.5 | 30.5 | 30.5 | 31.4 |

TABLE III

| Example | Residual activity in % of the initial value 12 weeks | 16 weeks |
|---|---|---|
| 1 | 95 | 65 |
| 1a | 20 | 0 |
| 2 | 75 | 60 |
| 2a | 58 | 0 |
| 3 | 90 | 63 |
| 3a | 20 | 0 |
| 4 | 95 | 60 |
| 4a | 20 | 0 |
| 5 | 100 | 66 |
| 5a | 20 | 0 |
| 6 | 65 | 45 |
| 6a | 58 | 0 |
| 7 | 80 | 50 |
| 7a | 65 | 20 |
| 8 | 73 | 52 |
| 8a | 65 | 20 |
| 9 | 75 | 50 |
| 9a | 65 | 20 |
| 10 | 90 | 83 |
| 10a | 58 | 37 |

These results show that the stability of the enzymes is substantially increased by the addition, in accordance with the invention, of alkoxylated alkylamines.

The preceding examples are illustrative of the practice of the invention. It is to be understood, however, that other expedients known to those skilled in the art or disclosed herein, may be employed without departing from the spirit of the invention or the scope of the appended claims.

We claim:

1. A stabilized liquid concentrate, useable as a washing and cleaning agent, consisting essentially of (a) 0.01 to 5% of an enzyme preparation containing enzymes selected from the group consisting of proteases, amylases, and mixtures thereof, (b) 0.5 to 40% of a nonionic surfactant, (c) 0 to 30% of an anionic surfactant, (d) 20 to 50% of water, (e) 0 to 50% of a solvent or additional water-soluble substance promoting the stability of the enzymes selected from the group consisting of monovalent alcohols having 1 to 3 carbon atoms, polyvalent alcohols having 2 to 6 carbon atoms and 2 to 6 hydroxyl groups, and ethers thereof, and, (f) relative to 1 part by weight of said enzyme preparation, 2 to 500 parts by weight of an alkoxylated alkylamine of the formula

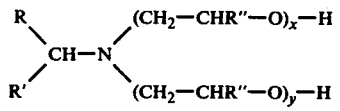

wherein R is an alkyl group having 4 to 20 carbon atoms, R' is a member selected from the group consisting of hydrogen and an alkyl group having 1 to 10 carbon atoms, provided that the total of the carbon atoms of R and R' is from 9 to 19 inclusive, R'' is a member selected from the group consisting of hydrogen, a methyl group, and a hydroxymethyl group, x is an integer from 1 to 5 inclusive, and y is 0 or an integer from 1 to 5 inclusive, provided that the sum of x and y is from 1 to 10 inclusive.

2. The concentrate of claim 1 consisting essentially of (a) 0.01 to 5% of the enzyme preparation, (b) 0.5 to 20% of alkoxylated alkylamine, (c) 0.5 to 40% of nonionic surfactant and (d) 20 to 50% of water.

3. The concentrate of claim 1 wherein the solvent or additional water-soluble substance promoting the stability of the enzymes is a member selected from the group consisting of monovalent alcohols having 1 to 3 carbon atoms and alkane diols having 2 to 6 carbon atoms and ethers thereof.

4. The concentrate of claim 1 consisting essentially of (a) 0.01 to 5% of the enzyme preparation, (b) 0.5 to 20% of the alkoxylated alkylamine, (c) 0 to 50% of monovalent alcohols having 1 to 3 carbon atoms, polyvalent alcohols having 2 to 6 carbon atoms and 2 to 6 hydroxyl groups and/or partial ethers thereof, (d) 0.5 to 40% of nonionic surfactants, (e) 0 to 30% of soap and/or sulfate- or sulfonate surfactant, (f) 0 to 25% of a member selected from the group consisting of hydroxyalkylamines having 2 to 8 carbon atoms per hydrocarbon radical, and derivatives of said hydroxyalkylamines which have at least one hydroxyl group in the molecule and are substituted on nitrogen by $C_{1-4}$ alkyl radicals, or by cyclohexyl or cyclopentyl groups and derivatives of said hydroxyalkylamines which are substituted on nitrogen by groups of the formula $$-R_1OR_2 \text{ or } -R_1\overset{\overset{\displaystyle O}{\|}}{C}-R_2,$$

wherein $R_1$ is alkylene of 2 or 3 carbon atoms, and $R_2$ is alkyl of 1 or 2 carbon atoms, (g) 0 to 1% of antimicrobial substances, (h) 0 to 20% of complex-forming builder substances, (i) 0 to 10% of solubilizing intermediaries selected from the group consisting of toluene-, xylene-, or cumene sulfonate, alkyl sulfates or alkane sulfonates having 6 to 8 carbon atoms in the hydrocarbon radical, and urea, (j) 0 to 1% of optical brighteners, dyes, perfumes, and opacifiers, and (k) 20 to 50% of water.

5. The concentrate of claim 1 wherein said enzyme preparation has an activity of 10 to 10,000 SKBE/gm amylase or of 1,000 to 1,500,000 PE/gm protease.

6. The concentrate of claim 5 which contains 5 to 200 parts by weight of the alkoxylated alkylamine to 1 part by weight of the enzyme preparation.

7. The concentrate of claim 5 wherein the enzyme preparation has an activity of 10,000 to 800,000 PE/gm protease.

8. The concentrate of claim 5 wherein the $$R'-\underset{\displaystyle |}{CH}-R$$

chain of the alkoxylated alkylamine is a straight-chain alkyl group having a total of 12 to 18 carbon atoms.

9. The concentrate of claim 5 which has a pH value of 7 to 11.

10. The concentrate of claim 5 wherein the total of x + y is 1 to 6 inclusive.

11. The concentrate of claim 5 which additionally contains one or more additives selected from the group consisting of (a) 0 to 25% of a member selected from the group consisting of hydroxyalkylamines having 2 to 8 carbon atoms per hydrocarbon radical, and derivatives of said hydroxyalkylamines which have at least one hydroxyl group in the molecule and are substituted on nitrogen by $C_{1-4}$ alkyl radicals, or by cyclohexyl or cyclopentyl groups and derivatives of said hydroxyalkylamines which are substituted on nitrogen by groups of the formula $$-R_1OR_2 \text{ or } -R_1\overset{\overset{\displaystyle O}{\|}}{C}-R_2,$$

wherein $R_1$ is alkylene of 2 or 3 carbon atoms, and $R_2$ is alkyl of 1 or 2 carbon atoms, (b) 0 to 1% of antimicrobial substances, (c) 0 to 20% of complex-forming builder substances, (d) 0 to 10% of solubilizing intermediaries selected from the group consisting of toluene-, xylene-, or cumene sulfonate, alkyl sulfates or alkane sulfonates having 6 to 8 carbon atoms in the hydrocarbon radical, and urea, (e) 0 to 1% of the optical brighteners, dyes, perfumes, and opacifiers, and (f) conventional quantities of washing alkalis and zwitterionic detergents.

12. The concentrate of claim 5 wherein R″ is hydrogen.

13. The concentrate of claim 12 wherein the total of x + y is 1 to 6 inclusive.

14. In the process of stabilizing a liquid concentrate, useable as a washing and cleaning agent, consisting essentially of (a) 0.01 to 5% of an enzyme preparation containing enzymes selected from the group consisting of proteases, amylases, and mixtures thereof, (b) 0.5 to 40% of a nonionic surfactant, (c) 0 to 30% of an anionic surfactant, (d) 20 to 50% of water, and (e) 0 to 50% of a solvent or additional water-soluble substance promoting the stability of the enzymes selected from the group consisting of monovalent alcohols having 1 to 3 carbon atoms, polyvalent alcohols having 2 to 6 carbon atoms and 2 to 6 hydroxyl groups, and ethers thereof, the improvement which consists essentially of using as stabilizer, relative to 1 part by weight of said enzyme preparation, 2 to 500 parts by weight of an alkoxylated alkylamine of the formula $$\begin{array}{ccc} R & & (CH_2-CHR''-O)_x-H \\ & \diagdown\ \diagup & \\ & CH-N & \\ & \diagup\ \diagdown & \\ R' & & (CH_2-CHR''-O)_y-H \end{array}$$

wherein R is an alkyl group having 4 to 20 carbon atoms, R′ is a member selected from the group consisting of hydrogen and an alkyl group having 1 to 10 carbon atoms, provided that the total of the carbon atoms of R and R′ is from 9 to 19 inclusive, R″ is a member selected from the group consisting of hydrogen, a methyl group, and a hydroxymethyl group, x is an integer from 1 to 5 inclusive, and y is 0 or an integer from 1 to 5 inclusive, provided that the sum of x and y is from 1 to 10 inclusive.

* * * * *